US006634656B1

(12) United States Patent
Gervasoni

(10) Patent No.: US 6,634,656 B1
(45) Date of Patent: Oct. 21, 2003

(54) ROLLER SKATES HAVING IMPROVED APPEARANCE AND FUNCTION AS WALKING SHOES

(76) Inventor: Bernard Gervasoni, 2400 San Gabriel Way, #206, Corona, CA (US) 92882

( * ) Notice: Subject to any disclaimer, the term of this patent is extended or adjusted under 35 U.S.C. 154(b) by 0 days.

(21) Appl. No.: 09/787,565

(22) PCT Filed: Sep. 16, 1999

(86) PCT No.: PCT/US99/21429

§ 371 (c)(1),
(2), (4) Date: May 8, 2001

(87) PCT Pub. No.: WO00/16862

PCT Pub. Date: Mar. 30, 2000

Related U.S. Application Data

(60) Provisional application No. 60/100,953, filed on Sep. 18, 1998, and provisional application No. 60/100,949, filed on Sep. 18, 1998.

(51) Int. Cl.[7] ..... A63C 17/18; B62K 13/00; A43B 5/04

(52) U.S. Cl. ..... 280/7.13; 280/11.223; 280/11.3; 36/115

(58) Field of Search ..... 280/7.13, 11.19, 280/11.221, 11.26, 11.25, 11.27, 11.3, 11.31, 11.32, 11.33, 11.223, 11.233; 36/15, 115

(56) References Cited

U.S. PATENT DOCUMENTS

| | | | | | |
|---|---|---|---|---|---|
| 3,884,485 | A | * | 5/1975 | Walle | 280/841 |
| 3,979,842 | A | * | 9/1976 | Texidor | 280/11.19 |
| 3,983,643 | A | * | 10/1976 | Schreyer et al. | 280/11.19 |
| 4,154,451 | A | * | 5/1979 | Young | 172/311 |
| 4,273,345 | A | * | 6/1981 | Ben-Dor et al. | 280/11.208 |
| 4,333,249 | A | * | 6/1982 | Schaefer | 280/11.19 |
| 4,928,982 | A | | 5/1990 | Logan | 280/11.22 |
| 5,388,350 | A | * | 2/1995 | Parker, Jr. | 280/11.19 |
| 5,398,970 | A | * | 3/1995 | Tucky | 280/11.19 |
| 5,423,195 | A | * | 6/1995 | Peters | 220/694 |
| 5,551,711 | A | * | 9/1996 | Mangelsdorf | 188/5 |
| 5,566,957 | A | * | 10/1996 | Ho | 280/11.223 |
| 5,803,469 | A | | 9/1998 | Yoham | 280/11.27 |
| 5,947,486 | A | * | 9/1999 | Zell | 280/11.21 |
| 6,042,125 | A | * | 3/2000 | Wu | 280/11.208 |
| 6,047,973 | A | * | 4/2000 | Amore et al. | 188/5 |
| 6,247,708 | B1 | * | 6/2001 | Hsu | 280/11.223 |

FOREIGN PATENT DOCUMENTS

WO WO-9829168 A1 * 7/1998

* cited by examiner

*Primary Examiner*—Jack Lavinder
*Assistant Examiner*—Melody M. Burch
(74) *Attorney, Agent, or Firm*—Ruton & Tucker LLP; Robert D. Fish

(57) ABSTRACT

Roller skates (10) having an improved appearance and function as walking shoes by providing at least one skate wheel (210) that can be pivoted by at least 60 degrees up inside the sole (100) of the skate to facilitate walking, and/or providing a skate with user replaceable, friction operated side brakes (410). Preferred skates have multiple such pivoting wheels coupled by a common, pivoting support arm (230), and provide a mechanism that positions the wheels substantially coplanar with the sole of the skate while in the walking position, and substantially perpendicular to the sole of the skate while in the skating position. It is also preferred that the skate wheels pivot about an axis passing through a portion of the wheels.

15 Claims, 5 Drawing Sheets

10
90
6
6
100
410
210
230
520
510
230
210
420
230
210
430

10
90
100
430
210
420
210
410
210

FIG. 3
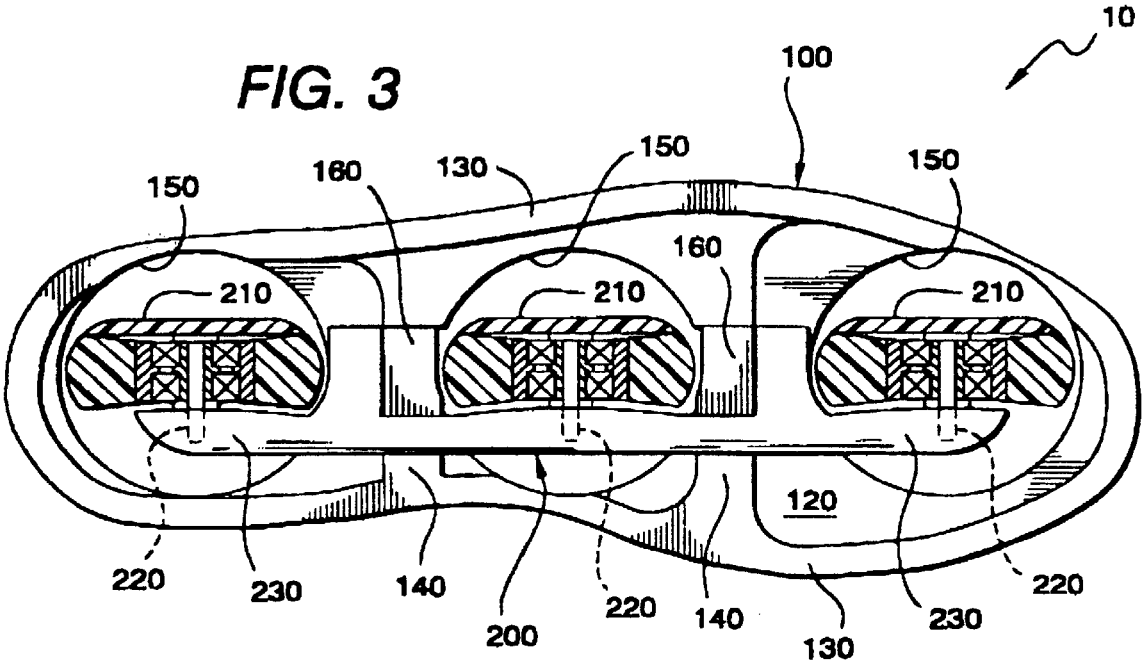
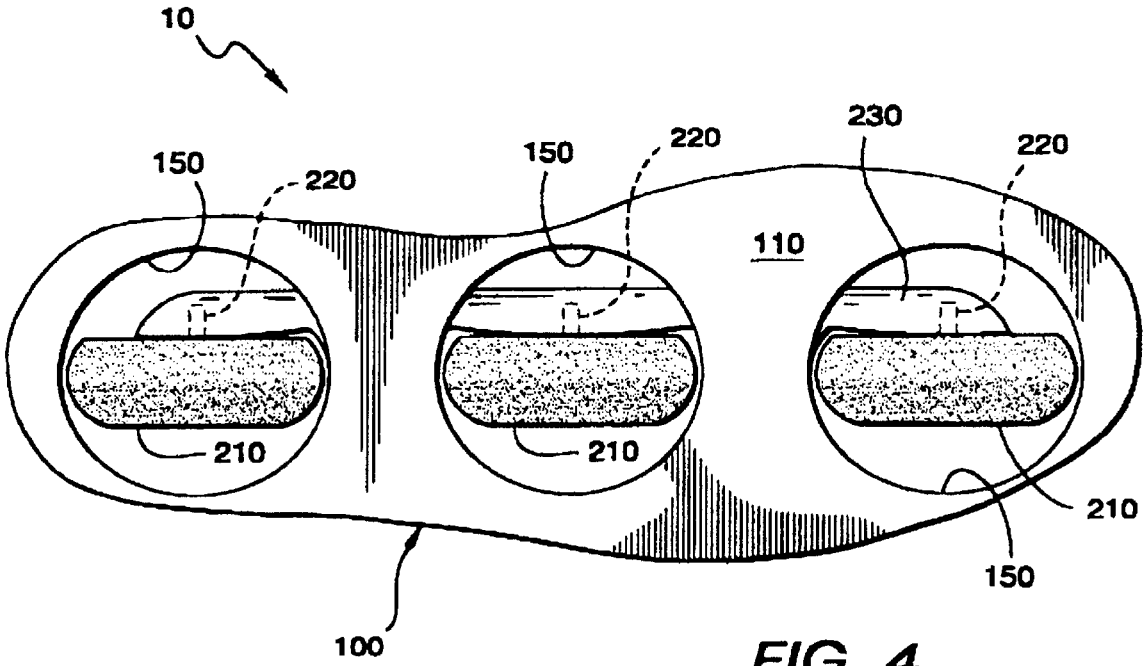
FIG. 4

ROLLER SKATES HAVING IMPROVED APPEARANCE AND FUNCTION AS WALKING SHOES

This application claims priority to PCT/US99/21429, filed Sep. 16, 1999, which claims priority to provisional patent application Ser. Nos. 60/100,949 and 60/100,953, both filed Sep. 18, 1998 (expired).

The field of the invention is roller skates.

DESCRIPTION

Roller skating has become a popular form of recreation throughout the world, particularly since the advent of in-line skates. There are, however, potentially significant drawbacks. One drawback is the need to carry and switch between a pair of skates for skating and a pair of shoes for walking. Another drawback is the difficulty of braking when using in-line skates.

It is known to address the need to carry and switch between walking and skating footwear by utilizing a convertible or "combination" shoe/skate. In one class of embodiments the wheels are locked into a vertical, skating orientation, and withdrawn into a receiving space formed within a sufficiently thick sole. Examples are U.S. Pat. No. 3,884,485 to Wälle (May 1975); U.S. Pat. No. 3,983,643 to Schreyer et al (October 1976), and U.S. Pat. No. 4,333,249 to Schaefer (June 1982).

Thick-soled shoes present considerable problems in walking, and other inventors have developed combination shoe/skates in which the wheels are vertically raised to the side of the sole. See, for example, U.S. Pat. No. 5,398,970 to Tucky (March 1995). That solution, however, produces a shoe that has undesirable visual characteristics.

It is also known to pivot the wheels about an axis so that they fold up into the sole of the shoe. U.S. Pat. No. 5,803,469 to Yoham (September 1998) describes a combination shoe/skate in which the wheels are carried by a frame that pivots between a vertical position for skating, and a horizontal position for walking. In the horizontal position the side of the frame facing downwards bears a soft rubber coating which acts as a sole for walking. The problem is that although the sole of the shoe is technically very thin, the mechanism employed makes the distance between a user's foot and the ground more than twice the thickness of the wheels.

U.S. Pat. No. 4,928,982 to Logan (May 1990) describes another solution in which canted wheels are employed to reduce the amount that the wheels must be pivoted between skating position and walking position. Unfortunately the canted wheel solution positions the sole of the shoe only a very small height above the ground while in the skating position making navigation difficult.

Accordingly, there remains a need in the field of roller skating for a convertible shoe/skate in which the wheels can pivot between a walking position that provides good walking characteristics, and a skating position that provides good skating characteristics.

With respect to braking mechanisms for in-line and other roller skates, it is known to provide continuous brakes, toe stops, forward axis brakes, heel pads, rear axis brakes, cable brakes, and leverage brakes. (see U.S. Pat. No. 5,232,231 to Carlsmith (August 1993) for a summary and evaluation of such mechanisms). Unfortunately, all of these known mechanisms still suffer from various drawbacks, including general difficulty of use and inadequate braking. Still further, the known methods of braking are quite inapplicable to convertible shoe/skates.

Accordingly, there also remains a need in the field of roller skating for novel braking mechanisms, and especially for braking mechanisms applicable to skates that convert into walking shoes.

SUMMARY OF THE INVENTION

The present invention is directed to improvements in roller skates that facilitate their appearance and function as walking shoes. One improvement involves providing at least one skate wheel that can be pivoted by at least 60° up inside the sole of the skate to facilitate walking. Another improvement involves providing a skate with user replaceable, friction operated side brakes.

In preferred embodiments the shoe/skate has multiple such pivoting wheels coupled by a common, pivoting support arm. It is also preferred that in the walking position the pivoting wheels are substantially coplanar with the sole of the skate, while in the skating position the pivoting wheels are substantially perpendicular to the sole of the skate. It is still further preferred that the skate wheel pivots about an axis passing through a portion of the wheels.

BRIEF DESCRIPTION OF THE DRAWING

FIG. 3 is a top view of the sole of the skate of FIG. 1, that has been detached from the foot receiving portion of the skate.

FIG. 4 is a bottom view of the skate of FIG. 1.

Various objects, features, aspects and advantages of the present invention will become more apparent from the following detailed description of preferred embodiments of the invention, along with the accompanying drawings in which like numerals represent like components.

DETAILED DESCRIPTION

Figure 1:
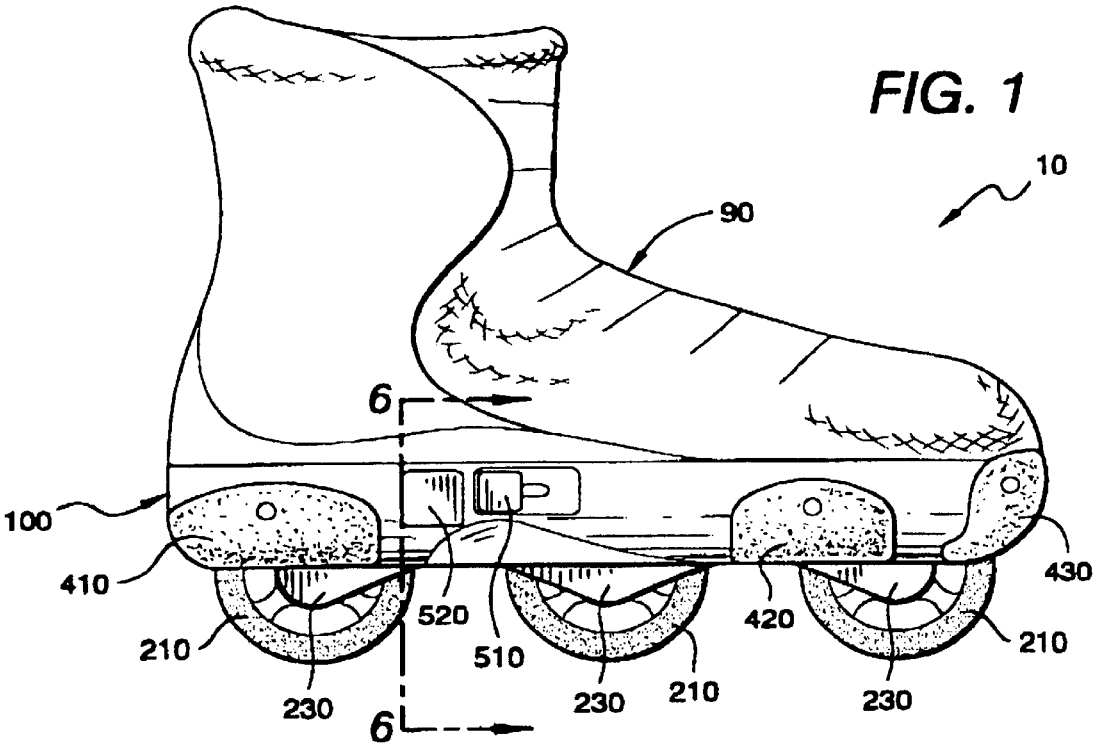
FIG. 1 is a lateral side view of a skate configured in the skating position.

FIGS. 1–9 are all views of an especially preferred type of skate 10 according to the present invention. The skate 10 generally comprises a foot receiving portion 90 and a sole portion 100, with the sole housing a wheel assembly 200, and having brake members 410, 420 and 430 disposed about its perimeter.

Figure 2:
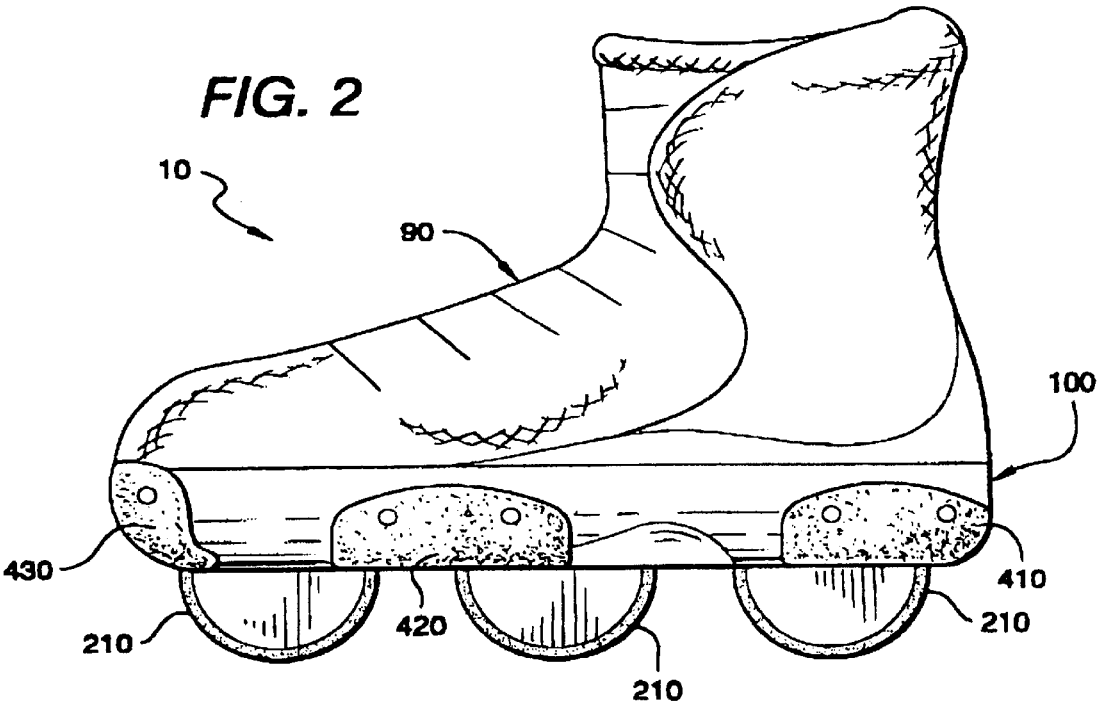
FIG. 2 is a medial side view of the skate of FIG. 1.

FIGS. 1 and 2 depict a heel brake 410, side brakes 420, and a toe brake 430. Each of these brakes is preferably user replaceable, meaning that they can be detached and re-attached by the user without permanently affecting the skate 10 in an adverse manner. Brakes 410, 420 and 430 are preferably operated by the user tilting the skate relative to the ground to such a degree that one or more of the brakes rubs along the ground.

Different embodiments may utilize differing number of braking surfaces. Thus, one embodiment may comprise a single braking surface, more than one braking surface, or even several braking surfaces. For example, a skate may have a combination heel/side brake 410, two side brakes 420, and a single toe brake 430 as shown in FIGS. 1 and 2. However, it is also contemplated that a skate may have a heel brake 310, four side brakes 320, and a toe brake 330 as in FIGS. 7 and 9. In still other contemplated embodiments a skate may not have any heel brake or toe brake.

The size of the braking surfaces may also vary. An embodiment utilizing a single or only a few braking surfaces may have braking surfaces which are larger than those in an embodiment utilizing several braking surfaces. The preferred dimensions of suitable brakes 410, 420, and 430 are that shown in the Figures.

The mechanisms used to mount the braking surfaces may vary between embodiments as well, and all appropriate methods of attachment are contemplated, including the use of mechanical connectors such as snaps, screws, and so forth, as well as chemical connectors such as glues and adhesives. In some embodiments, a braking surface may be mounted in a manner so as to maintain the braking surface in a position which is fixed relative to some other portion of the skate. In other embodiments, a braking surface may be mounted in a manner which allows the surface to be retracted and extended. Still other embodiments, in addition to or as an alternative to allowing the position of the braking surface to move, may allow the orientation of the surface to change to allow the braking surface to become more parallel to the surface the braking surface rubs against.

The mechanisms used to mount the braking surfaces may also allow the braking surfaces to be detached and/or attached to the skate for easy replacement or repair. If more than one braking surface is used, two or more braking surfaces may be mounted in a manner which allows them all to be detached or attached at the same time. For example, the combination heel/side brake 410 allows both heel and side brakes to be detached and replaced at the same time.

Materials useful for such frictionally operated brakes are known, with the preferred materials being whatever material is currently enjoying the most prevalent usage. In general it is preferred that the braking surfaces be formed from materials that provide both a relatively high coefficient of friction and increased durability so as to resist wear through use.

FIG. 1 also depicts a sliding lock 510 and trigger 520 used in transitioning the wheels 210 between the walking and skating positions. This mechanism is discussed in greater detail with respect to FIGS. 5 and 6.

In FIGS. 3 and 4 the sole 100 of skate 10 includes a bottom surface 110, an interior cavity 4120, side walls 130, reinforcing members 140, wheel wells 150, and wheel assembly mounting brackets 160, and a wheel assembly 200 having three skate wheels 210, wheel axles 220, and wheel support arms 230.

Figure 7:
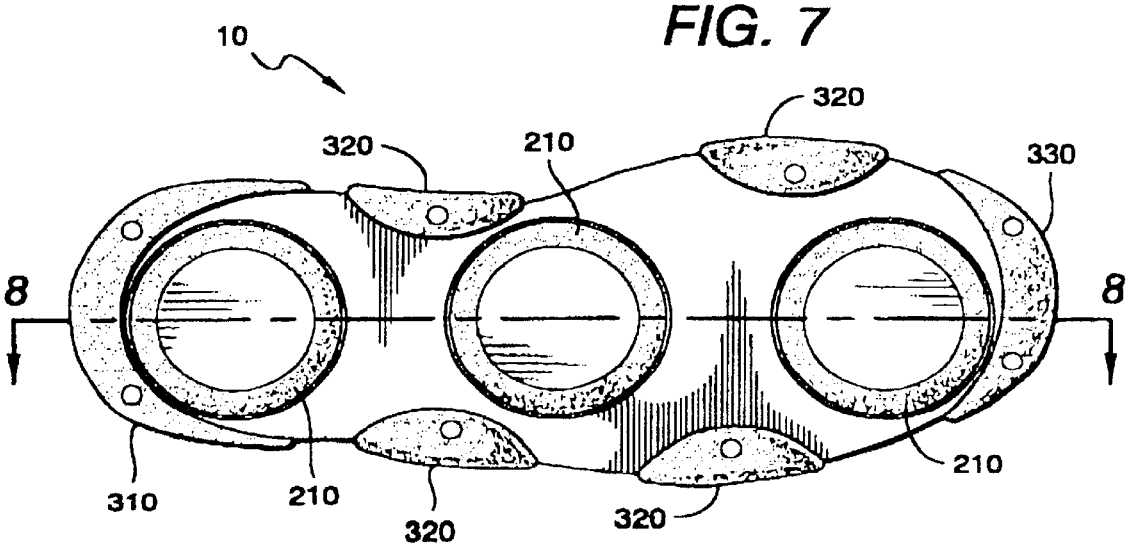
FIG. 7 is a bottom view of an alternative embodiment of the skate of FIG. 1, configured in the walking position.
Figure 8:
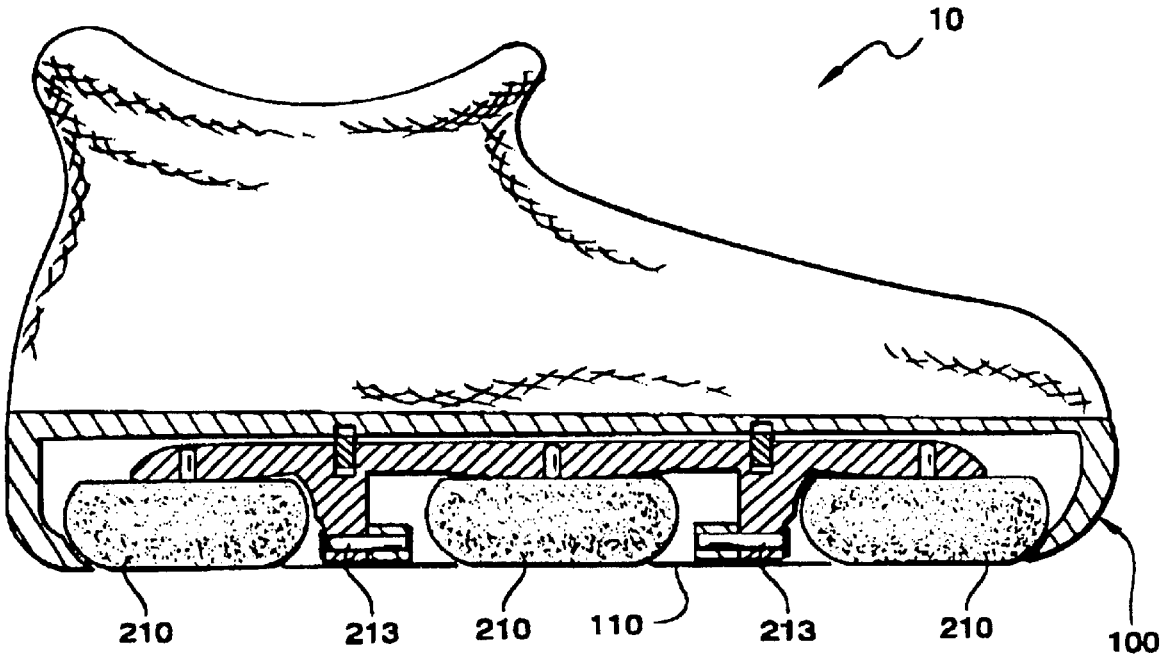
FIG. 8 is a vertical cross section of the skate of FIG. 7 taken along the line 8—8.

Sole 100 is not limited to any particular sizes and/or dimensions so long as it is thick enough to enclose a cavity large enough to contain the wheel assembly 200 when it is "collapsed" or retracted into the sole 100 as in FIGS. 7 and 8. Thus, the soles of various embodiments may differ in thickness $\geqq$N where N is one of 0.5, 1, 1.5, 2, 2.5, and 3 inches. The sole 100 may be made from any material suitable for enclosing the assembly and providing sufficient support while walking, and is preferably at least somewhat flexible and/or segmented. The bottom surface of the sole 110 is preferably chosen to provide suitable traction while walking, and to be relatively durable during expected usage.

The interior cavity 120 of sole 100 need not have any particular shape. However, a cavity 120 sized and dimensioned to closely conform to the shape of the wheel assembly 200 may be somewhat sturdier than one which is unnecessarily large.

The side walls 130 of the cavity 120 should, in conjunction with any reinforcing members 140 which may be included, provide sufficient support to allow the skate to be walked on while the wheel assembly 200 is retracted. Rounding the lower portion of the sole as shown in FIGS. 3, 4, 7 and 8 may further improve the walking characteristics of the skate.

The wheel assembly 200 may be, but is not necessarily, a standard assembly for an in-line skate, with minor modifications to facilitate pivoting of the wheels into and out of the sole 100, and to facilitate locking of the wheels in the respective skating and walking positions. Similarly, the wheels 210 are preferably standard in-line skate wheels, having standard diameters. It is thought that a diameter of approximately 2.25" may be especially suitable. It is especially contemplated that the wheels 210 can be mounted to a single supporting arm 230 via axles, pins, or other appropriate wheel mounting methods.

The wheel supporting arm 230 may be rigid, or may be capable of flexing in one or more directions. Allowing the support arm to flex up and down when the wheel assembly is retracted, coupled with a flexible or segmented sole, is contemplated to provide a significant improvement in utilizing the skate for walking. Improved walking characteristics may also be obtained by allowing at least a portion of the assembly to rock, or otherwise move, within the cavity while the assembly is collapsed. Other embodiments may use multiple support arms located on one or both sides of the wheels.

In some embodiments, the wheel assembly 200 will be mounted to the wheel assembly mounting brackets 160 via pins, around which the assembly rotates while transitioning between walking and skating configurations.

Figure 5:
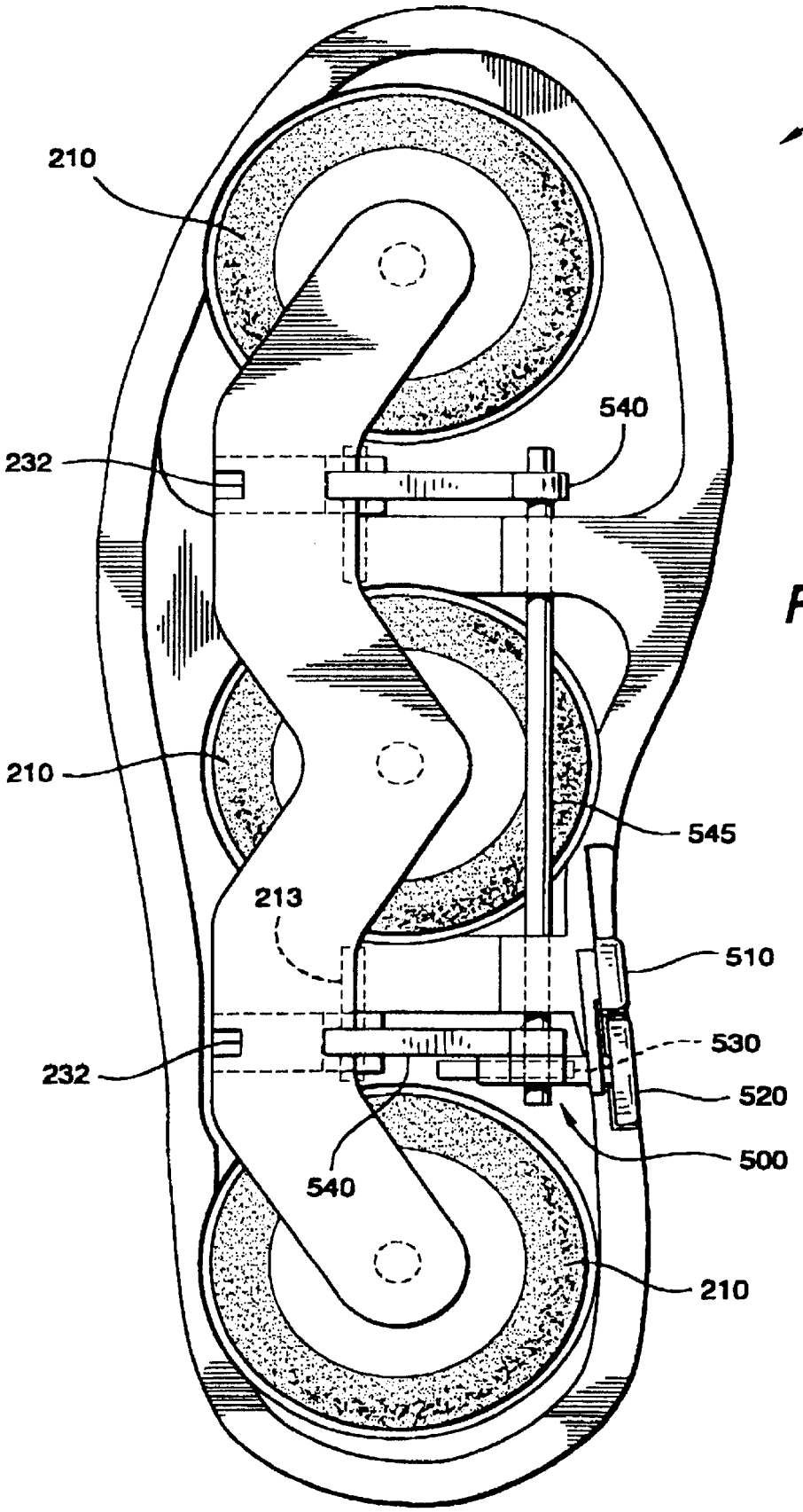
FIG. 5 is a top view of the sole of FIG. 3, configured in the walking position.
Figure 6:
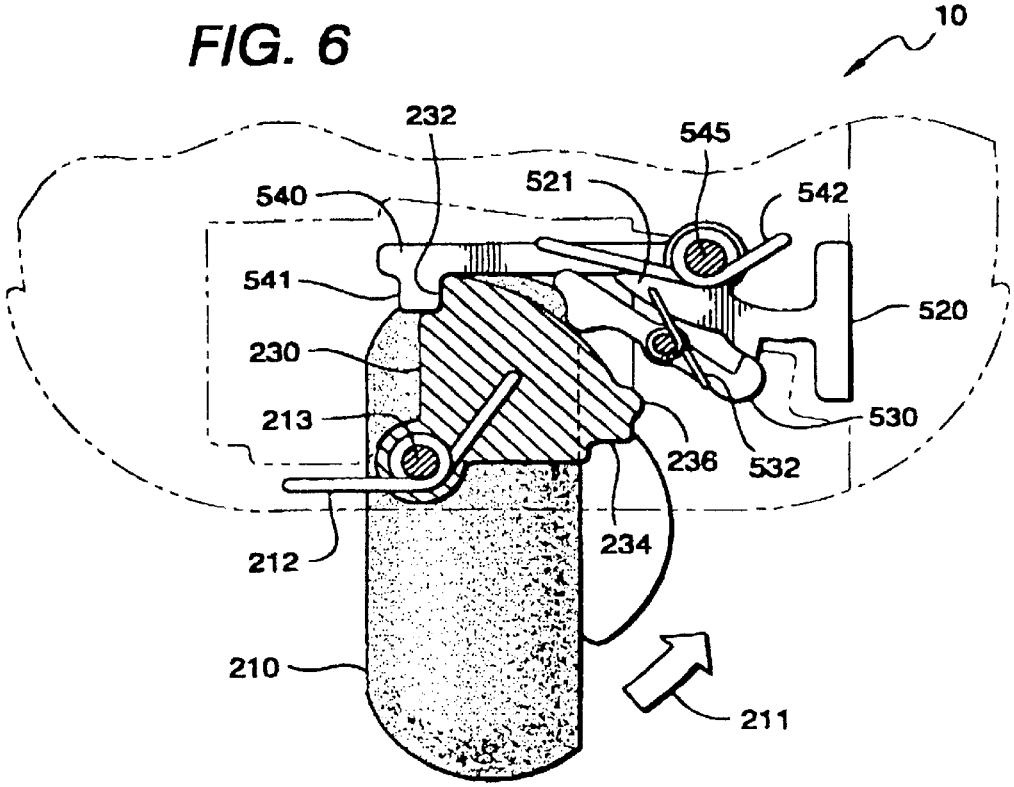
FIG. 6 is a forward view of the locking mechanism of the skate of FIG. 1 taken along a vertical plane at the line 6—6.

FIGS. 5 and 6 depict the locking mechanism omitted from FIG. 3 for the sake of clarity. The locking mechanism 500 comprises a sliding lock 510, a trigger 520, a latch 530, a locking bar 540, and notches 232, 234, and bump 236 disposed on the supporting arm 230. In this particular embodiment there are two locking bars 540 coupled by a coupling bar 545.

To transition from the walking position shown in FIG. 5 to the skating position shown in FIG. 6, the user depresses trigger 520 medially. Both trigger 520 and locking bar 540 are rotatably mounted on coupling bar 545, so that depressing trigger 520 pushes the trigger finger 521 against locking bar 540, which pivots locking bar 540 clockwise. (All clockwise and counterclockwise directions herein are taken as viewed from the rear of the skate.) This action disengages locking finger 541 from walking position notch 234, allowing spring 212 to pivot wheel 210 clockwise. Continued clockwise rotation of the wheel 210 eventually causes the locking finger 541 to engage skating position notch 232, which holds the wheel 210 in the skating position. The entire operation is spring biased, with latch spring 532 biasing latch 530 counterclockwise, locking bar spring 542 biasing locking bar 540 counterclockwise, and wheel spring 212 biasing wheel 210 clockwise. Wheel spring 212 is positioned about axis 213, which axis may advantageously pass through the pivoting wheels to improve the efficiency of space utilization with the sole 100.

To transition from the skating position shown in FIG. 6 to the walking position shown in FIG. 5, the user again depresses trigger 520 medially. This action again causes locking finger to push up against the locking bar 540, which causes the locking finger to disengage from skating position notch 232. In addition, depression of trigger 520 catches latch 530 on trigger 520, which keeps the finger 541 disengaged from notch 542 so that the user can manually, or by stepping downwards, rotate one of the wheels 210 counterclockwise as shown by arrow 211. Towards the mid-point of the counterclockwise rotation the bump 236 strikes latch 530, which disengages the latch 530 from the trigger 520, which causes the locking finger 541 to press down upon the support arm 230, and eventually engages the locking finger in walking position notch 234.

Figure 9:
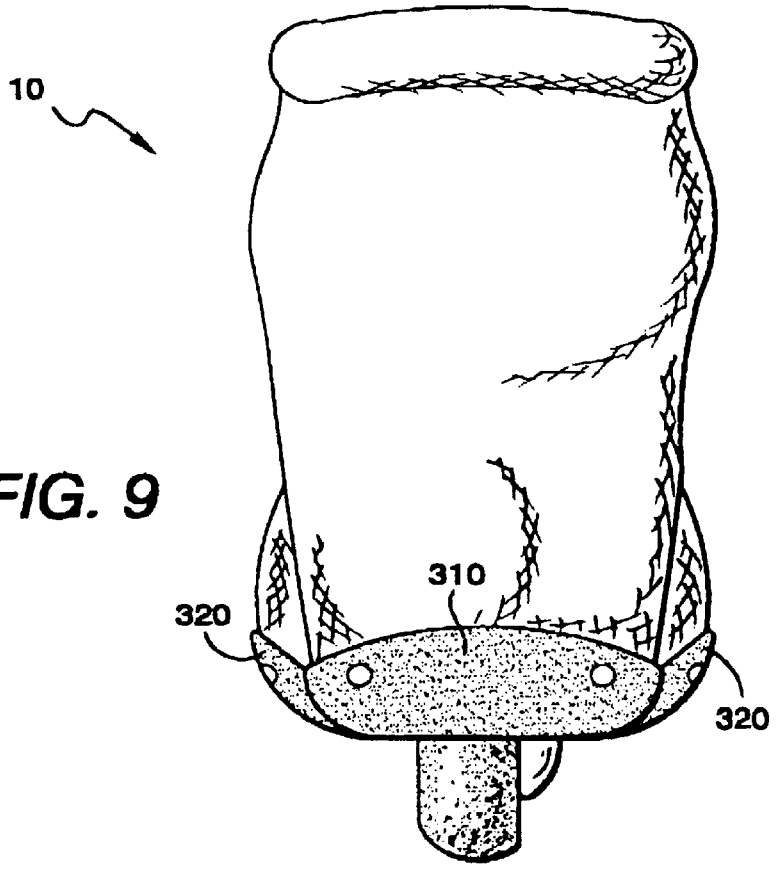
FIG. 9 is a rear view of the skate of FIG. 7.

FIGS. 7, 8, and 9 provide additional views helpful in understanding various aspects of the inventive subject matter.

Thus, specific embodiments and applications of improved roller skates have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a nonexclusive manner, indicating that the referenced elements, components, or steps may be present, or utilized, or combined with other elements, components, or steps that are not expressly referenced.

What is claimed is:

1. A convertible shoe/skate comprising:

a sole having a walking surface defining an opening to a cavity;

a skate wheel coupled to the sole and pivoting between a walking configuration in which the wheel is stowed substantially inside the cavity, and a skating configuration in which the wheel extends outside the cavity in a position suitable for skating, wherein such pivoting is about an axis passing through a portion of the wheel.

2. The shoe/skate of claim 1 further comprising a second pivoting skate wheel and a third pivoting skate wheel.

3. The shoe/skate of claim 2 wherein at least two of the skate wheels are coupled by a support arm that pivots about the axis with the axis passing through a portion of each of the at least two skate wheels.

4. The shoe/skate of claim 3 wherein the support arm is operatively coupled to a release mechanism that is laterally actuated from a side of the sole.

5. The shoe/skate of claim 2 having second and third cavities to receive the second and third skate wheels.

6. The skate of claim 2 wherein the skate wheels are coplanar.

7. The shoe/skate of claim 1 wherein the skate wheel is spring biased towards the skating position.

8. The skate of claim 1 wherein the sole is flexible.

9. The shoe/skate of claim 1 further comprising:

a first user replaceable, friction operated side brake coupled directly to the sole.

10. The shoe/skate of claim 9 having a second user replaceable, friction operated side brake.

11. The shoe/skate of claim 10 wherein the first and second side brakes are mounted on the shoe/skate using a detachable mounting mechanism.

12. A roller skate having improved appearance and function of a walking shoe, comprising:

a sole defining an opening to a cavity and coupled to at least two skate wheels that pivot through the opening at least 60° between a walking configuration in which the wheel is stowed substantially inside the cavity, and a skating configuration in which the wheel extends outside the cavity in a position suitable for skating, wherein such pivoting is about an axis passing through a portion of the at least two skate wheels.

13. The roller skate of claim 12 wherein the skate wheels are coplanar.

14. The roller skate of claim 13 wherein each of the skate wheels is operatively coupled to a release mechanism that is laterally actuated from the same side of the sole upon which a friction brake is disposed.

15. The roller skate of claim 12, further comprising a first user replaceable, friction operated brake disposed on a side of the sole.

* * * * *